United States Patent [19]

Alvarez-Calderon

[11] 4,072,018

[45] Feb. 7, 1978

[54] TUNNEL SUPPORT STRUCTURE AND METHOD

[76] Inventor: Alberto Alvarez-Calderon, 1560 Castilleja St., Palo Alto, Calif. 94306

[21] Appl. No.: 627,685

[22] Filed: Oct. 31, 1975

[30] Foreign Application Priority Data

Apr. 30, 1975 Sweden ..... 7505069
Apr. 30, 1975 France ..... 75 13654

[51] Int. Cl.[2] ..... E21F 15/00; E21F 13/00

[52] U.S. Cl. ..... 61/35; 61/45 F; 264/32; 299/11

[58] Field of Search ..... 61/35, 36 R, 45 R, 63, 61/45 F; 299/11, 12; 249/65; 264/32, 314

[56] References Cited

U.S. PATENT DOCUMENTS

| | | | |
|---|---|---|---|
| 1,876,205 | 9/1932 | Crom | 264/32 |
| 1,987,958 | 1/1935 | Klie | 61/36 R |
| 2,116,464 | 5/1938 | Matthews | 249/65 |
| 2,990,166 | 6/1961 | Walsh | 299/11 |
| 3,508,407 | 4/1970 | Booth | 61/35 |
| 3,562,056 | 2/1971 | Olson | 264/32 |
| 3,937,025 | 2/1976 | Calderon | 61/35 |

FOREIGN PATENT DOCUMENTS

| | | | |
|---|---|---|---|
| 1,069,549 | 7/1956 | Germany | 299/11 |
| 1,108,160 | 12/1958 | Germany | 299/11 |

*Primary Examiner*—Paul R. Gilliam
*Assistant Examiner*—Alex Grosz
*Attorney, Agent, or Firm*—Limbach, Limbach & Sutton

[57] ABSTRACT

In this invention there is taught the use of air tubes or fluid-filled containers to define permanent hollow tubular space within a body of solidified fill material placed in a mining excavation.The fill uses a mixture of solids and liquids with the addition of a structurally binding substance such as cement in order to make the fill substance permanent and capable of providing structural integrity and strength in the fill notwithstanding the empty tubular space. The empty tubular space can be used in accessways for mining and hauling of ore, or ventilation; it can also be used to provide volume within which to place fine component of tailings of a concentrator, or to store contaminants, or to route fill material. The tubular empty space within the fill reduces the weight, time and cost of the fill operation, and eliminates the need to drive galleries in waste rock, or of constructing costly timbered galleries or steel tubes within the stope prior to backfilling with tails. The fill provides support to the excavation, and permits work to be done below or above the fill substance. Mining methods are specified for the invention, including the use of raises, galleries and ramps in stopes. Apparatus is provided for the construction of large diameter inflatable tubes, having low surface tension. Air tubes that permit passage of workmen below the tube are specified, to permit progress of work while concrete roofs are setting. Special designs of hollow inflatable tubes using ring elements and axial elements are specified. There is taught method and apparatus for the use of inflatable tubes acting as moulds or forms for construction of concrete tubes, in which the tube's fabric substitutes firstly conventional wood or metal forms, and can remain integrated to the tube's concrete fill providing tension elements in substitution of steel.

22 Claims, 26 Drawing Figures

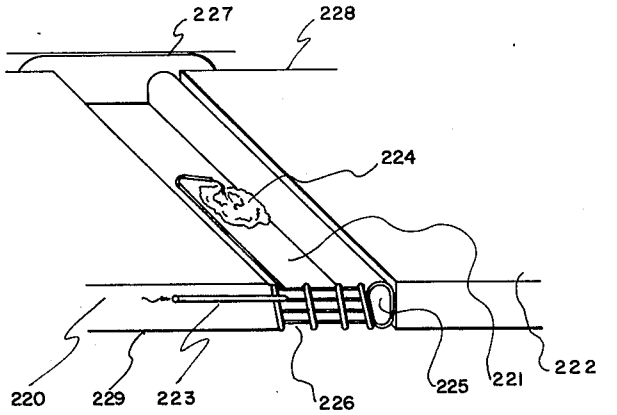
FIG. 26
FIG. 9
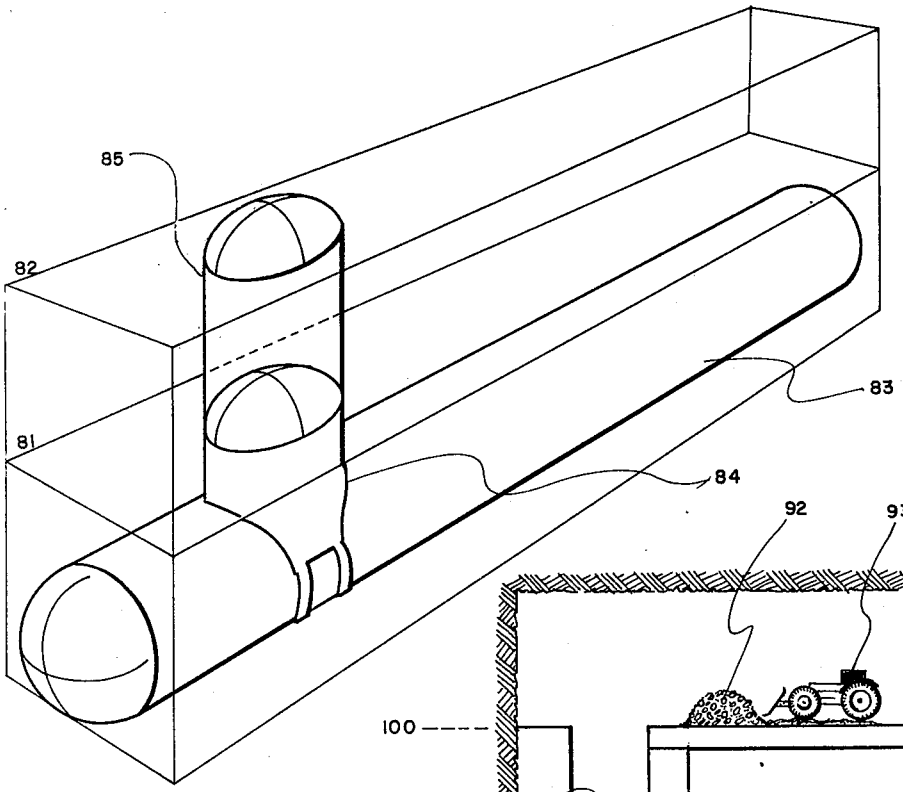
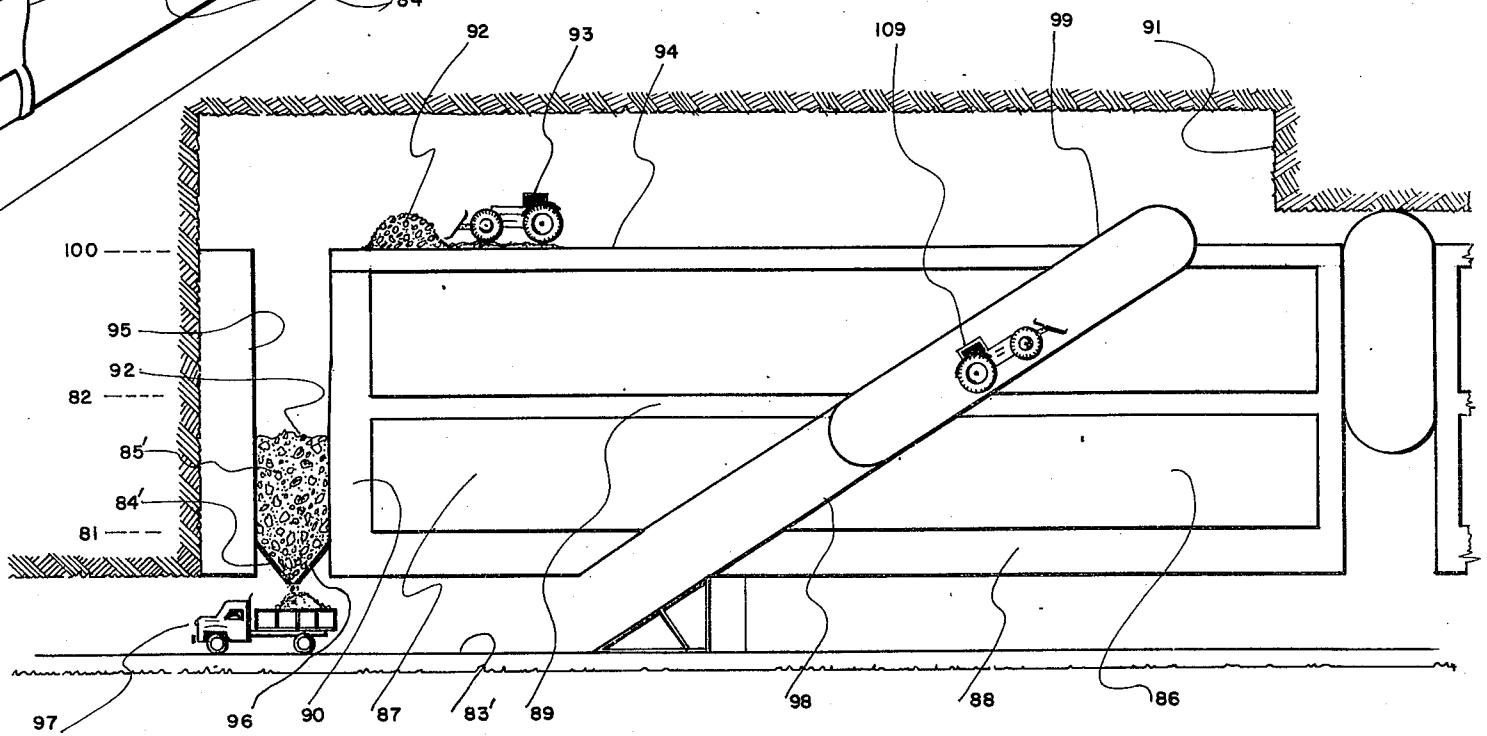
FIG. 10

TUNNEL SUPPORT STRUCTURE AND METHOD

BACKGROUND OF INVENTION AND REVIEW OF PRIOR ART INTRODUCTION

It is common knowledge that in cut-and-fill stoping operations, the fill phase frequently presents serious difficulties which prevent continuous, stable and highly mechanized mine production.

Over the last decades, mechanic fill has been replaced in various mines by fluid fills, such as hydraulic and pneumatic fills. In these methods, the fill is prepared in adequate places, and then is distributed through pipes, allowing a larger production at lower cost.

The use of a large portion of the slurry or tailings of a concentrating plant as a component of the fluid fill in an underground operation satisfies the following main objectives:

Structural support of the mined out zones; and

Underground storage of the tailings from the concentrating plants.

As a structural support, the fluid fill, once solidified, is one of various possible systems in mining.

As an underground system of disposing of the tailings of a concentrator, the hydraulic fill is many a time an imperative procedure for ecological reasons, or because of lack of an adequate place to store it on the surface.

Even though fluid fills represent a step forward in the technique of preparing and distributing the fill internally within the mine (as compared with mechanical fill), complex problems still subsist.

In the case of orebodies in heavy ground, the descending method of cut-and-fill uses intermediate concrete slabs such as is shown in FIG. 1. The tailing-cement ratio in slabs 1, 2 and 3 can be 6 to 1, and in the rest of the fill, identified as 4 and 5, the ratio can be 20 to 1.

In the case of vertical or steep veins, the ascending method of cut-and-fill is employed, often using cement slabs at the top of each fill phase. In such an application, the tailings to cement ratio may be 10 to 1 in the slab, and very much larger in the remaining portion of the fill.

Some of the disadvantages and problems of fluid fills are as follows:

Only the coarse component of the tailings are adequate to provide structural function in hydraulic fill, thus there remains an ecological and storage problem with the fine component of the tailing, or slimes which can amount in certain cases up to 50% of the tailings at the concentrator.

The fill material in the stopes blocks access haulage and ventilation throughout the mined areas once these are filled, necessitating often the driving of haulage and ventilation galleries off the ore, which is costly and utilizes mine equipment for non-productive purposes.

In other cases, in which principal galleries must be kept open through a backfill area, there is need to construct artifical timbered tubes, as in FIG. 6, or costly steel tubes in the stopes as in FIG. 7, prior to the application of the fill.

The weight of the fill material sometimes presents serious structural problems in structural stability, particularly in the descending cut and fill method shown in FIG. 1.

The transportation of the tailings from plant to mine is often costly, and sometimes not feasable if there is a great difference of elevation between mine and plant.

Such problems in fill back operations as reviewed above are solved, and new beneficial features of hydraulic and pneumatic fill are made possible, by means of the apparatus and methods of the present invention, in which inflatable, or fluid filled structures are immersed in fillback material with cement, as is described hereafter in the invention, to define hollow permanent tubular accessways and haulageways within the solidified fill. Sufficient advantages stem from the method to permit using low cost cemented or concrete fill in mining.

Such earlier work which has been done with inflatable systems in mining do not cover the subject of the present invention as can be seen by comparing the specifications and drawings of the present invention to those of the following prior art:

U.S. patent application Ser. No. 356,591 now U.S. Pat. No. 3,937,025 of Alvarez Calderon, related to the use of inflatable bags to keep fill away from the side of a stope:

French Pat. No. 1.008.534 of Haarmann teaches the use of tubular structures in mines to support the roof of the stope;

German Pat. 1.069.549 teaches the use of multicellular inflatable tubes supported by roof and floor for lateral containment of backfill.

PURPOSE AND OBJECTIVES OF THE INVENTION

It is one purpose of the invention to provide apparatus and methods utilizing fluid-filled structures to define hollow tubular spaces within solidified fluid fill material in an excavation, to provide accessways suitable for ore haulage with trucks, locomotives, and other vehicles.

Another purpose is to provide pressurized gas containers such as air bags to define hollow spaces within the fill to provide spaces for fluid motion of material, such as ore on belts, water for drainage, and air for ventilation.

Another purpose is to teach the method for adequate mixture and use of fill together with structural substances such as cement to permit the formation of hollow spaces round inflated tubular containers placed in fillback material of mined excavations.

Another purpose is to provide apparatus and method to substantially diminish the amount of material needed to fill an excavation, by providing structurally permanent hollow spaces within the fill defined by fluid filled structures.

Yet another purpose is to provide apparatus and methods to diminish substantially the amount of fillback material needed for structural hydraulic fillback, in mining stopes, in special cooperation with the concentrator plant, such that the amount of tailings actually needed are equal to the coarse components of the tailings of the concentrator normally available for fillback.

Yet one more purpose is to provide method to utilize the empty hollow spaces of fill of the invention to deposit into them the fine tailings or slimes of the concentrator which are not suitable for structural fillback.

Yet another purpose is to use hollow empty space of the kind specified above, to store contaminant from the concentrator plant or other industrial processes, such as arsenic, acids, or fumes which precipitate within the hollow spaces.

Yet another purpose is to use air bags to lighten fill material in excavation when mining in descending cut and fill methods.

Yet another purpose is to provide structure and methods to use air bags to define haulageways below stopes in ascending cut and fill mining operations, such as to transfer the mined ore by gravity to the haulageway below.

Yet another purpose of the invention is to specify the use of air tubes or air bags of the kind described for making raises, inclines and galleries within fill material in mining.

Another purpose of the invention is to provide method and apparatus to construct large air tubes sustained in circular form by air pressures but having nevertheless low surface tension.

Yet another purpose of the invention is to provide method and apparatus to construct passages employing one or more air tight bags within an external tension supporting net, with axial drainage provided for the fill.

Yet one more purpose is to provide method and apparatus for constructing concrete tubes supported by air tube.

Another purpose of the invention is to construct inflatable tubular temporary support for the construction of tunnels within heavy ground.

One more purpose of the invention is to provide inflatable tubular structures combining a ring of large diameter using inflatable ring elements and orthogonal or diagonal inflatable axial elements.

Yet another purpose of the invention is to provide method and apparatus for the construction of large diameter air tube which have low surface tension with the aid of rings used to attach the tubes to the ground and prevent displacement of the tubes under the action of buoyant forces generated by externally applied fill.

Yet another purpose of the invention is to utilize fabric tubes in substitution for timber or moulds to support concrete, and in substitution of steel for reinforcement against tension and bursting forces with concrete.

BRIEF DESCRIPTION OF DRAWINGS

FIG. 9 is an isometric view of the use of air bags to define extraction galleries and raises within the fill.

FIG. 10 is a side view of the exploitation method of FIG. 9 for trackless mining.

FIG. 26 shows the use of two inflatable tubes to define a longwall mining font and lateral accessways within fill material.

DETAILED DESCRIPTIONS OF DRAWINGS

Figure 1:
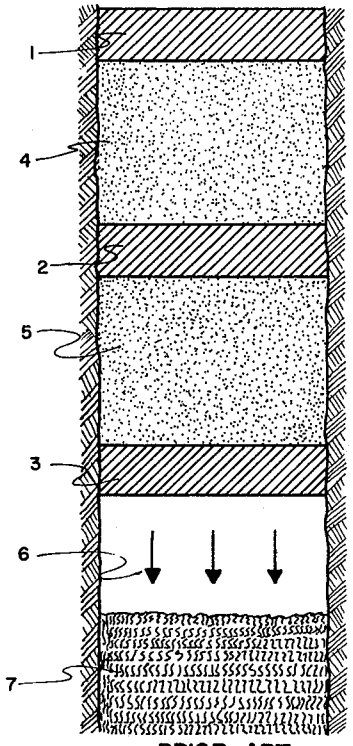
PRIOR ART FIG. 1
FIG. 1 shows conventional descending cut and fill method using intermediate concrete slabs.

FIG. 1 shows in section view a conventional descending cut-and-fill operation in which mining proceeds in downward directions 6 towards ore 7. Previously mined cuts have been filled with a mixture of solids and liquids such as tailings from a concentrator plant. The main body of the fill is shown as 4 and 5 corresponding in two previous cuts. The fill has low cement content in the order of 1 to 20, or can have even no cement, except at the slabs 1, 2 and 3, where cement mixture is in the range of 6 or 9 parts of fill to one of cement. Mining of ore 7 is done under protection of slab 3.

Figure 2:
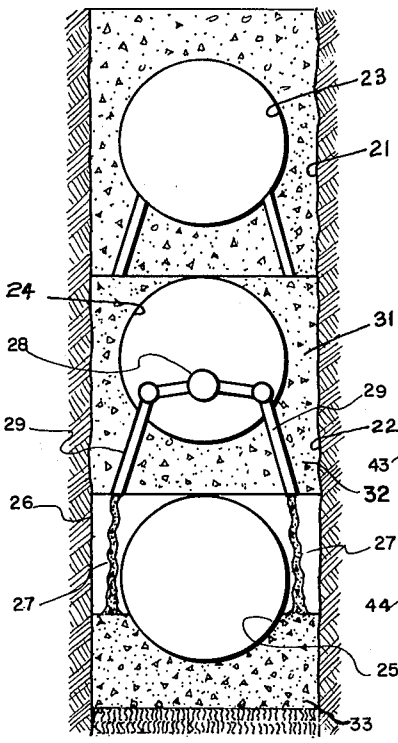
FIG. 2 shows a lightened or honeycomb fill system of decreased volume according to the method and apparatus of the invention, as applied to descending cut and fill mining.

FIG. 2 shows the new kind of lightened or honeycomb fill for descending cut-and-fill operations, in which inflatable tubes are preplaced in the stope before fill is applied.

FIG. 2 shows two upper cuts 21 and 22 which have already been filled with cement mixed with tailings at areas 31 and 32, with their lightening tubes or tunnels 23 and 24 within the fill having been formed with the aid of a reusable air tube which is shown in FIG. 2 as inflated tube 25, within stope 26.

From within lightening tube 24 hydraulic fill 27 with cement is applied from pipe 29 through preplaced tubes 28, in order to accumulate as solidifying fill 33. Fill 33 presses the inflated tube 25 against the roof, that is, against previously solidified fill 32. As more fill 27 is poured, the level of 33 makes contact with the fill 32, integrating structures 31, 32 and 33.

Once fill 33 is completed and solidified, a new stope can be cut below 33 to continue the downward mining cycle.

The entire fill of the system of FIG. 2 uses cement or a similar substance, in ratios in the range of 4 to 10 parts of fill to one of cement, depending on the size of stopes and type of terrain. However, since the volume of fill is about one half of conventional fill of FIG. 1, the total amount of cement needed for the new system is not much greater, and in certain cases less, than with conventional fill. However, the new fill because of its reduced volume, weighs less, takes less time to pour, has less total cost of fill application, is stronger because of its higher cement ratio, and can be completed using only the coarse component of tailings of a concentrator.

Since only the coarse component of the tailings can be used adequately for fillback anyway, and that component is about 50% of total tailings, there is established a special cooperation between my new lightened fill system, and conventional fillback with tailings, in that no foreign aggregates need be added (as would be the case in FIG. 1) to complete the fill in the stope.

Figure 3:
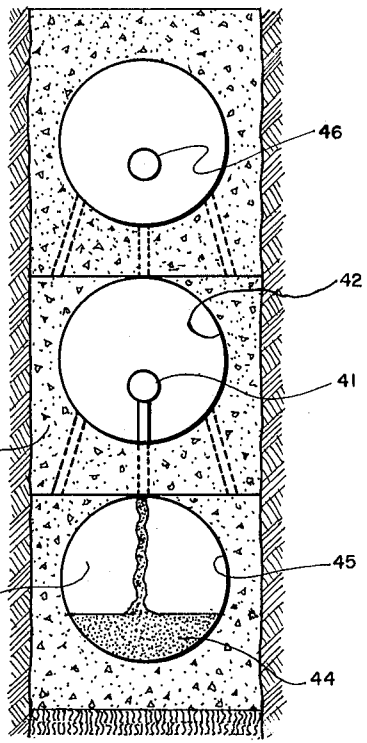
FIG. 3 shows the lightened or honeycomb fill system of the invention in which the tubular lightening holes in the fill are used to store and deposit the fine component of the concentrator tailings, and industrial contaminants.

Moreover, in my new system the fill components of tailings of the concentrator need not be left on the surface, with the ecological and storage problem this presents. Instead, once the lightened structural fill is completed, a second phase of fill is initiated and established, in which the piping system is reused to pour fine component of tailings, and/or contaminants of an industrial process, into the lightening tubes of the first solidified structural fill. This is shown in FIG. 3 with aid of pipe 41 placed within lightening tube or tunnel 42 within solidified fill 43. Pipe 41, previously used for structural fill, is used in FIG. 3 to pour fine component of tailings and/or contaminants 44 into lightening tube 45. As tube 45 is filled, pipe 41 is withdrawn and hollow tube 42 is filled in turn from pipe 46. Thus the filling with fines or contaminants proceeds in an ascending manner, after the descending structural fill is completed.

Figure 4:
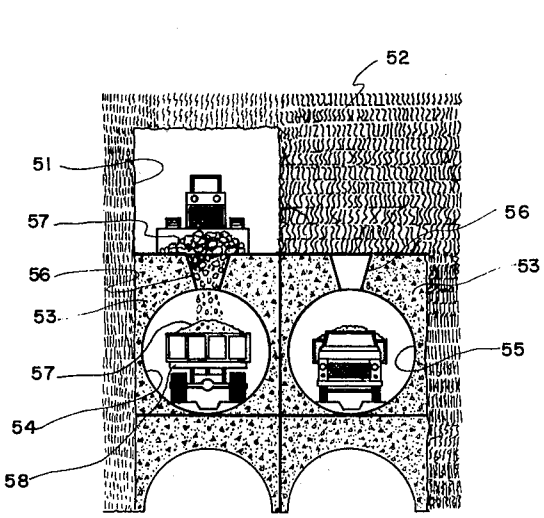
FIG. 4 shows the fill system of the invention in a combined application in which the fill volume is reduced and the empty spaces are utilized to extract ore by trucks; the ore is fed by gravity from the upper stopes.

FIG. 4 shows the combined application of my lightened hollow fill system to ascending cut-and-fill mining.

Stope 51 is being cut from ore 52 above previously-cut stopes filled with my lightened fillback system having structural fill 53 with lightening hollow tubes or tunnels 54 and 55.

In this application, I combine the ore transportation system with the lightening tubes, by utilizing these tunnels or tubes as paths for ore carrying vehicles, here shown as trucks, 58.

Ore 57 cut from stope 51 is pushed by low cost bulldozers, through floor shoot 56, into the bin of a truck 58. The truck returns by adjacent hollow tube 55, and is driven to the concentrator.

In the system of FIG. 4, the entire operation is carried out by conventional road building and hauling equipment. The entire pathway system within the fill represents no extra cost to the lightened fill concept. Shoots are formed by preplaced inflated or solid plugs before fill is applied, which are deflated, withdrawn or destroyed after the fill is solidified.

Figure 5:
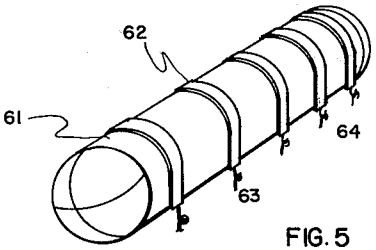
FIG. 5 shows an inflated air bag tied down to the floor by means of floor bolts.
Figure 11:
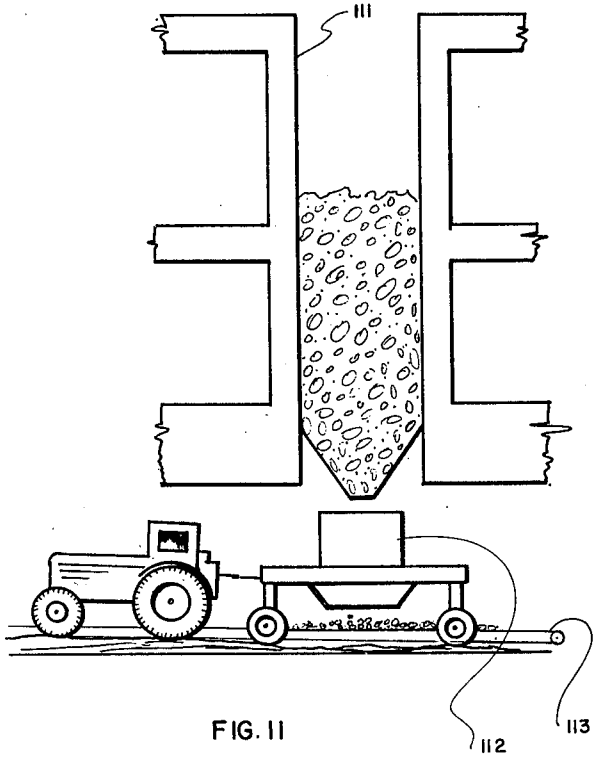
FIG. 11 is a side view of the exploitation method of FIG. 10 with coarse crusher and fine ore belts underground.

In ascending cut and fill operations, inflatable air tubes are preplaced within the stope prior to the fill phase, secured against the ground or side of the stopes by belts tied against floor bolts or side bolts on the floor or sides of the stope. FIG. 5 illustrates correct placement of inflated air bag 61 secured by numerous belts 62 to hooks 63 preplaced in cemented fill floor 64.

In the FIGS. 2–5 I have presented embodiments of the invention covering the lightened fill concept alone, and combined with haulageways. I will now review the use of air tubes to define principal extraction galleries in mining.

Figure 6:
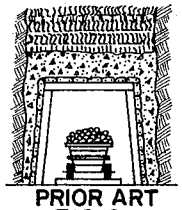
PRIOR ART FIG. 6
FIG. 6 shows a conventional timbered gallery constructed before fill material is applied, to define an accessway.

FIG. 6 shows a typical timbered gallery at the base of a stope which has been filled with conventional hydraulic fill. Such timbered galleries are costly and time consuming to build.

Figure 7:
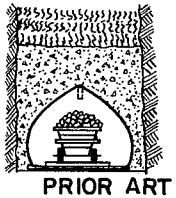
PRIOR ART FIG. 7
FIG. 7 shows a conventional steel-plate gallery immersed in fill material to define an accessway.

FIG. 7 shows a typical steel-tube type gallery which is also expensive, as the steel plate is not reusable, and requires some cement in the fill.

Figure 8:
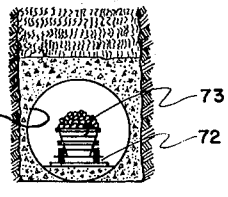
FIG. 8 shows the use of inflatable tubes to construct haulageways inside fillback with cement.

FIG. 8 shows my new type of gallery in which an inflatable tube is preplaced in the stope and secured to the floor as in FIG. 5, with the inflated tube tight against the rails. The fill is mixed with cement, in ratios in the order of 4 or 6 to 1 as it is poured, and is allowed to drain at one end of the gallery. The inflatable tube is then withdrawn leaving gallery 71 with rails 72 on which locomotive haulage of ore in railway car 73 is made.

Although the quantity of cement, or other coagulants, used in FIG. 8 may be greater than in FIG. 7, the time of erection of the tube is very short, and the air tubes are reusable, hence the cost of the gallery within the air tube is substantially lower than that of the conventional timbered gallery or steel plate systems.

FIG. 9 shows the structure of FIG. 8 incorporating vertical inflatable tubes to construct raises.

After first cut of stope to level 81 is completed, horizontal tube 83 is positioned in place, for example, as per FIG. 5. Before back fill is applied, inflatable tube 84 is strapped to 83 to define the contours of the raise once fill is applied to level 81.

Thereafter a second cut is mined to level 82, and before applying the corresponding fill, an inflatable tube 85 is inserted into the raise defined by 84, whereby, once fill has attained level 82, a continuous raise exists from level 82 to principal extraction gallery 83.

The resulting ascending cut-and-fill operation is shown in FIG. 10. Fill 88 up to level 81 has cement added to define a permanent extraction gallery 83'.

Principal portion of fill 86 and 87, up to near level 82, can be with no cement, or with little cement in the ratio of 1 to 20. The upper layer 89 at level 82 should have a cement slab. Preferably, a larger addition of cement should also be used at 90 near raise 85'. Region 90 can be separated by a bulkhead from region 86. Alternatively local cement injection can be made near 90.

FIG. 10 illustrates trackless mining combined with haulageway defined by withdrawn inflatable structures. Upper cut 91 in the stope produces ore 92 which bulldozer 93 pushes along upper cement slab 94 down raise 95-85'-84'. A bin mouth 96 is provided at bottom of the raise.

Raise 95-85'-84' acts as a coarse ore bin for the stope. Truck 97 carries ore to the concentrator. Bulldozer 93 stays on top of the fill in small lateral excavations as the ascending cut-and-fill mining proceeds. Bulldozer 93 can return to principal gallery 83 with the aid of inclined ramp 98 which is constructed within the fill and slabs with the aid of inclined inflatable tubes. FIG. 10 teaches how to place an inflatable tube 99 to construct the inclined ramp between levels 100 and 82.

FIG. 10 also teaches the placing of the bulldozer or load-have-dump type vehicle inside an inflatable air bag in position 109 while the fill phase proceeds. After fill is solidified, an operator for the vehicle can drive it up the inclined ramp formed by tube 99, to upper level 94, to continue the mining operation. Also, additional vehicles can be brought up from main gallery 83 to upper working level 94 of stope by means of ramp 98-99.

As the radius *r* of air tube increases, for a given internal pressure P the surface tension T of the material increases with the radius *r*. .

Also, for an air tube immersed horizontally in a fluid and sustaining external pressures Q by means of internal pressure P, the internal pressure P is increasing with *r*, since the external hydraulic pressure Q applied to the tube depends on the diameter of the tube, that is, on *r*.

Hence the surface tension T on the material increases with radius *r* raised to a power greater than one.

Therefore, the cost of material for air bags increases rapidly as the diameter of the tube is increased. Furthermore, a limit is reached in which light weight foldable fabric is no longer a practical material to support stresses.

I have investigated various types of design and method solutions for permitting the construction of large size air tubes or air bags with decreased surface tension notwithstanding the application of the necessary internal pressures.

One solution consists in the method of applying the fill. It must be applied in separate steps or delayed phases, or at slow pace, such that the lower portions of the fill is solidifed partially by drainage and coagulation before the upper portion of the fill is applied. Ingredients for fast mixture settings are used.

Figure 12:
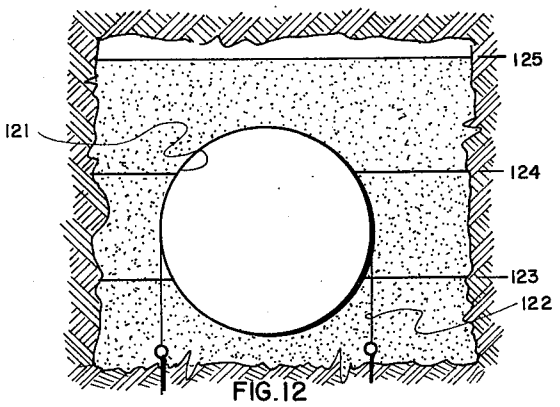
FIG. 12 shows a phased fill method to permit minimum surface tension on air bags of larger diameter.

For example in FIG. 12 large air tube 121 of a diameter of the order of 15 feet is secured in place with belts 122 to floor bolts. Then fill with cement and coagulants or additives to increase the rate of setting is applied only up to level 123 and is allowed to solidify such that shear forces can be developed by the fill, i.e., it no longer behaves as a pressure-transmitting fluid. This can occur in periods of 3 to 10 hours, depending on the mixture.

Thereafter fill is applied to level 124 and again it is allowed to solidify for about the same period. Finally fill is completed to level 125. By this method, low internal pressures can be used, in the range of 1.5 psi, with low surface tension but with a large radius tube.

Another solution to decrease surface tension without decreasing the large size of the air tube or its internal pressure is the use of one, two or more tubes of small diameter and therefore requiring reduced surface strength, held within a net of higher tensile strength, such as a nylon net, or a standard fishing net, or a metal mesh, or a wire mesh.

Figure 13:
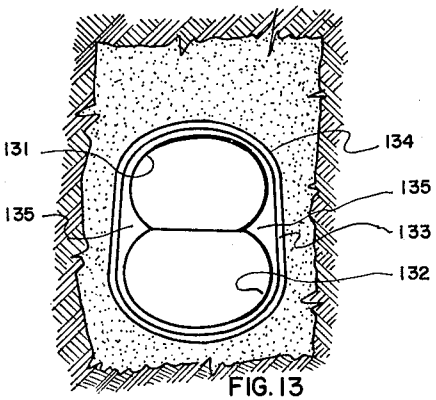
FIG. 13 shows a combined bag design to provide minimum surface tension and axial drainage.

FIG. 13 illustrates how two small diameter tubes 131 and 132 are held within nylon net 133 into an oval shape. Around the sides of the net there is provided burlap 134.

Space 135 serves to provide drainage of backfill firstly radially across burlap and net, and then axially along space 135 between the inflated tubes, providing for a rapid drainage and quick solidifying process, and therefore diminished external pressures on the air tubes.

The system of FIG. 13 is therefore most efficient to decrease cost of air tubes by decreasing effective radius of tubes and its surface tension without decreasing overall height, and with specially-cooperating axial drainage for rapid firming up of fill and decrease of hydraulic external pressures.

The structure of FIG. 13 also permits special cooperation for the construction of manways and locomotive ways in the fill of narrow veins, as it is shown in FIG. 13, because of the small width of the tube. Three tubes, or more, within nylon net 133 are advantageous to define different and various cross-sectional shapes to the combination.

Figure 14:
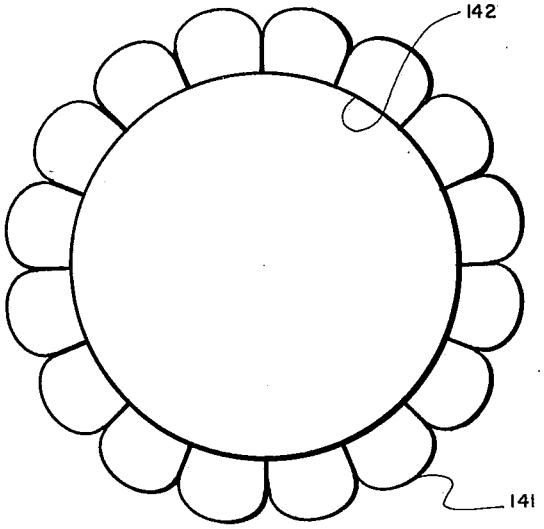
FIG. 14 shows the use of a large diameter internal tube with low pressure and small diamter external peripheral tubes with large pressure, the entire structure having small surface tensions.

FIG. 14 shows a different air bag design solution in which there are combined several small diameter tubes 141 defining the entire periphery of a large diameter tube 142. For a given strength of material, internal pressure of small diameter tubes 142 can be about five times that of the large tube in the drawing shown, that is, in inverse proportion to their radius. Internal pressure in tube 142 provides stability against inward buckling of tubes 141; and tubes 141 are prevented against outward buckling by the tensile strength of the material as well as by external loads. As shown external tubes 142 also act against external compression as an arch. Hence a large overall diameter is achieved with low surface tension in material.

Figure 15:
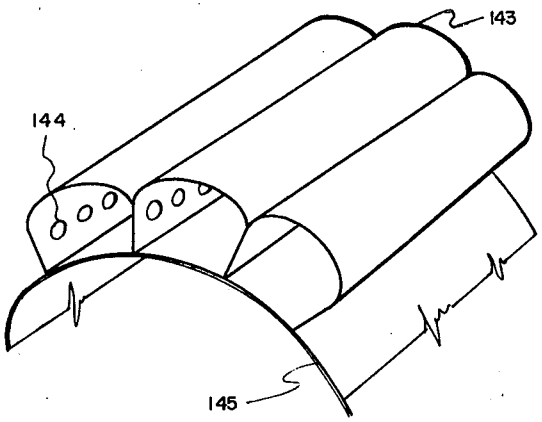
FIG. 15 shows a detail of FIG. 14.

FIG. 15 shows an air tube similar to that of FIG. 14, except that peripheral tubes 143 are interconnected by holes 144 to equalize inflation and pressures in the peripheral band around main tube 145.

Figure 16:
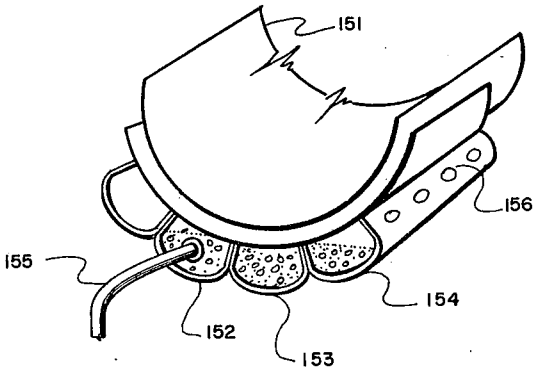
FIG. 16 shows the combined use of gas and concrete fluid fill, on a structure having a large internal air tube to provide form, and an external matrix of axial tubes to provide a concrete mould.

FIG. 16 shows a different concept in which a large diameter inflated tube 151 supports by its internal pressure, a separate external peripheral band or ring of small diameter tubes 152, 153, 154, and additional tubes (not shown for clarity) around the periphery of 151, completely encircling 151. In FIG. 16, once tube 151 is inflated with air, the separate peripheral tubes are filled with concrete which is inserted by means of hose 155 and transmitted to adjacent peripheral tubes with the aid of communicating holes such as 156 in tube 154.

Once the concrete, or similar structural substance, is solidified, central air tube 151 can be withdrawn and reused.

Peripheral tubes 152, 153, 154 and others, can remain glued to the concrete, acting as tension elements when the peripheral concrete structure is subjected to gravity forces, or external loads, and thereby reinforcing the concrete structure.

Figure 17:
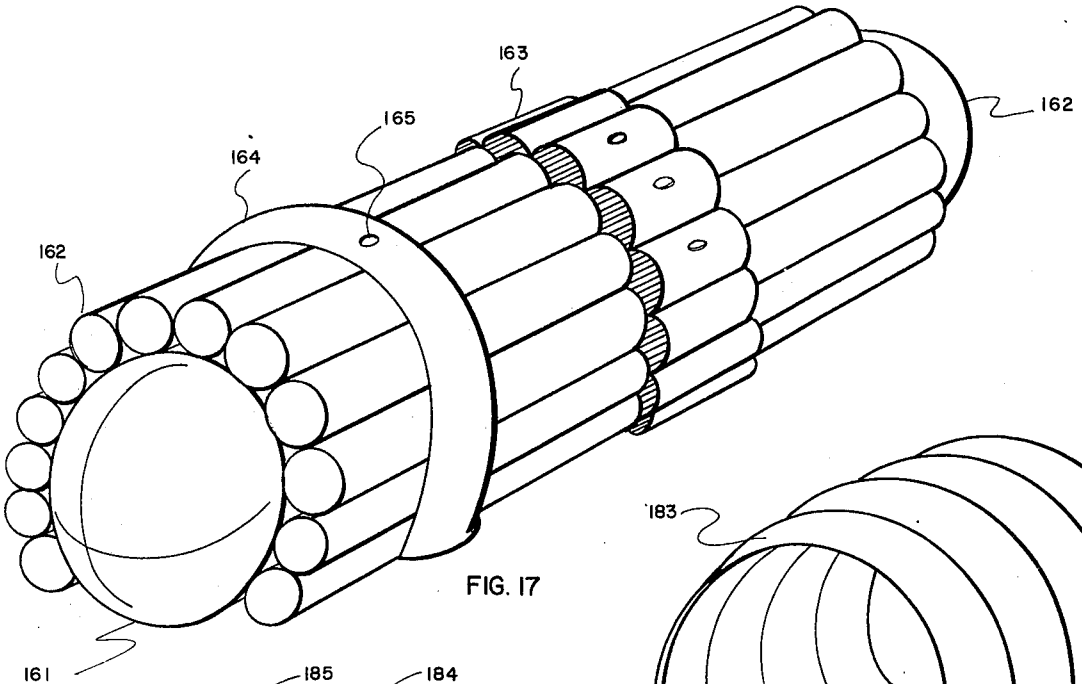
FIG. 17 shows a combination of inflatable endspheres, inflatable axial tubes, inflatable rings and optional concrete tubes to define a large diameter structure with small surface tensions.

FIG. 17 shows in isometric view and inflatable structure using some of the teachings of FIGS. 14 and 16. Around inflated end spheres 161 and 162 of large diameter in FIG. 17, there is disposed in tubular fashion, a circular band composed of small diameter inflated tubes 162, thereby constructing an efficient large diameter semi-rigid tube with small surface tension on the material. The total external diameter is that of one sphere, plus twice that of the peripheral tubes.

Around external tubes 162 there can be applied external pressure, such as from backfill with or without cement. Another form of external pressure can be that of an additive external band of concrete tubes such as 163. External tubes can be filled with concrete one after the other or simultaneously.

FIG. 17 also shows a stabilizing external ring 164 which can be filled through valve 165, either with air under pressure or with concrete.

Figure 18:
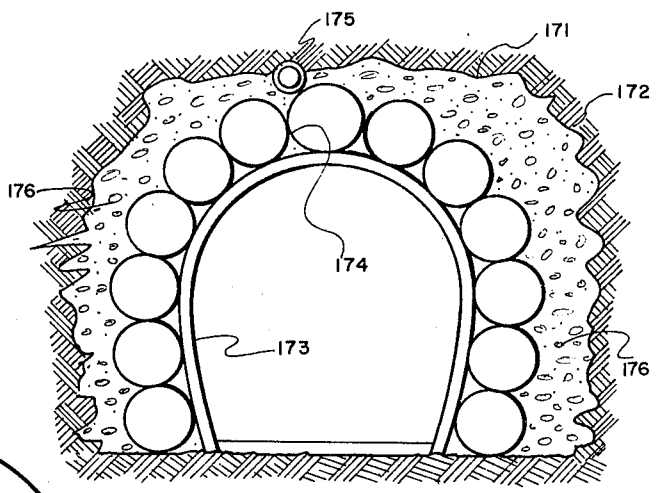
FIG. 18 shows the application of tubular sheets to support roof concrete in galleries on heavy ground.

FIG. 18 shows a mine gallery 171 on heavy ground 172 which needs roof support. This is provided by steel arches 173 which in turn support temporary inflatable tubes 174 disposed as an external surface band, instead of conventional wood or steel planking. On top of 174 there is placed an insulating sheet and thereafter concrete 176 is applied by pipe 175 to provide permanent support for roof 171. After concrete is firmed up the band of air tubes is withdrawn and can be reused.

Figure 19:
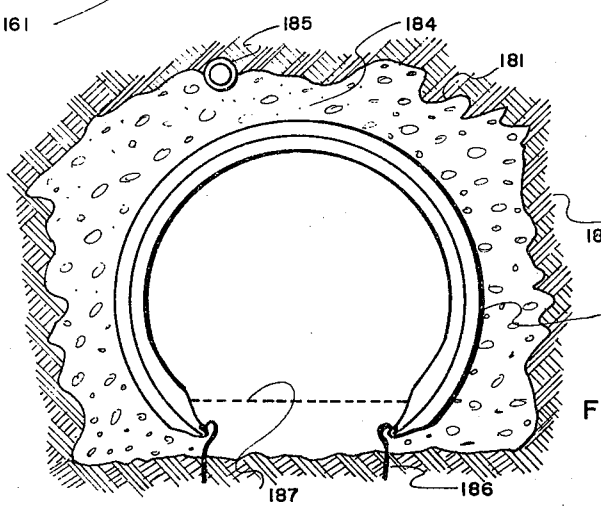
FIG. 19 shows the use of inflatable rings, to support roof of galleries in heavy ground.

FIG. 19 shows a mine gallery 181 on heavy ground 182 needing roof support. This is provided temporarily by inflatable arches 183 on top of which there is placed concrete 184 through pipe 185 to provide a permanent arch support for roof 181. After concrete is solidified inflatable arch 183 is deflated, collapsed, and is ready for use again.

Inflatable arch 183 is secured to the floor by means of floor bolts 186. After the inflatable arches are removed, the sides of the cast arches are stablized with a concrete floor 187.

It should be noted that a peculiar design feature in FIG. 19, as well as in FIG. 18, is that work and access to the front of the gallery is had below the inflatable structure with the protection provided by inflatable tubes against falling rocks. Thus work at this gallery's front can proceed while the concrete is solidifying. This is important for rapid advances of the front, and can be essential for rescue missions.

Figure 20:
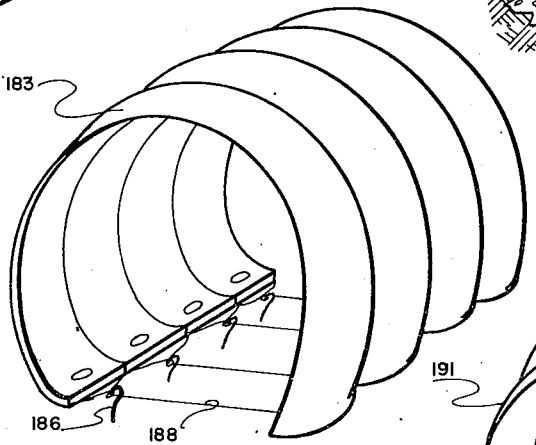
FIG. 20 is a partial isometric view of FIG. 19.

FIG. 20 is an isometric view of the tubes of FIG. 19 showing how the inflatable tubes conform into a large diameter tunnel. The small diameter of the tubes permit low surface tension with high internal pressures. FIG. 20 also shows floor cables 188 at the bottom of each arch tube in order to define the width of floor of the tunnel, acting against internal pressure tending to open the arches.

The structure of FIG. 20 need not be limited to mining applications, but is also useful to construct large rooms or buildings, such as theatres, conference rooms, etc.

Figure 21:
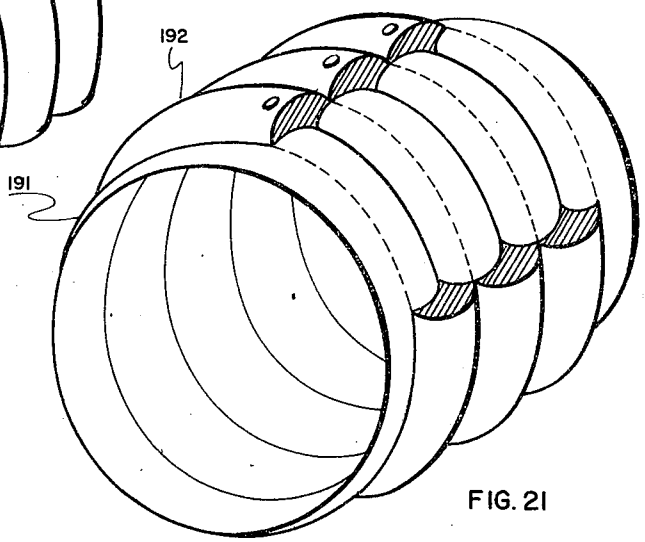
FIG. 21 shows the combination of internal air rings and external concrete mould rings to fabricate tubular structures.

In FIG. 21 I show the use of contiguous inflatable internal rings 191 to provide support for external contiguous rings 192 into which a concrete type material is poured to construct an external tube made by the sum of contiguous external rings.

Figure 22:
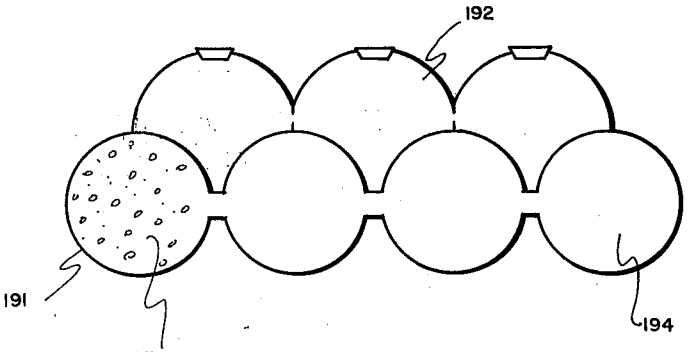
FIG. 22 shows a modification of FIG. 21, in which after external concrete rings are solidified, internal rings are filled also with concrete.

As shown in FIG. 22, once the concrete-like substances are solidified within external rings 192, then the internal rings 191 can be gradually filled with concrete also, with the external rings at that time providing the necessary support. In FIG. 22, internal ring 191 is shown with concrete, whereas other internal rings as yet contain air 194 under high pressure, and are yet to be filled with concrete. The sequence of concrete application can be reversed, that is, internal rings can be firstly filled with concrete, and thereafter the external rings can be filled.

Figure 23:
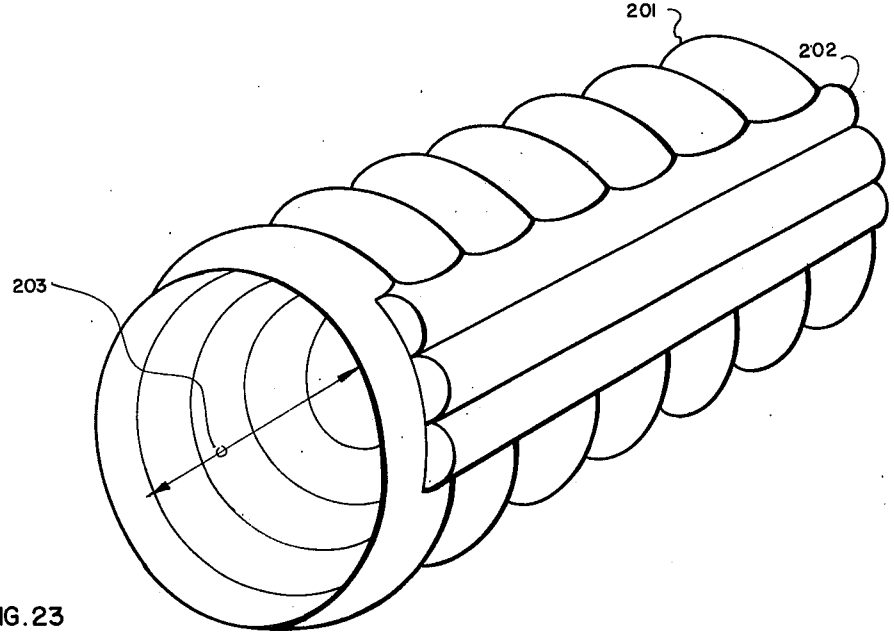
FIG. 23 shows a combination of inflatable rings and axial tubes to provide reusable inflatable structures of very large diameters.

FIG. 23 shows the construction of inflatable rings 201 and inflatable axial tubes 202 to provide a cylindrical tube of large diameter 203 with large internal air pressures and small surface tension in tubes 201 and 202.

Figure 24:
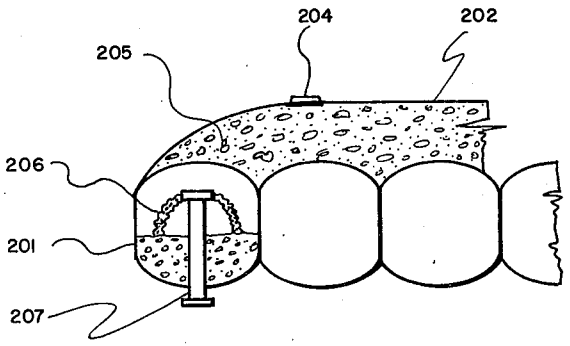
FIG. 24 shows a modification of the structure of FIG. 23 in which, in two time phases, axial tubes are filled with concrete at a separate time, such that at the end, one concrete set reinforces the other.

In FIG. 24, there is shown a modification of the structure of FIG. 23, in which concrete 205 is poured into outer tube 202 by valve 204 while 202 is supported by internal rings under air pressure. Once concrete is solidified, and while it is still being supported by some rings under internal air pressure, other rings such as 201 are filled with concrete 206 by means of valve 207. At the end of the process both external tubes and internal rings are filled with solidified concrete having also fabric reinforcement for tension. Fabric substitutes steel as tension reinforcement elements, with the added feature that fabric prevents bursting of concrete under compression and gives a good surface finish. The structure permits the construction of large diameter tubes, tunnels, roofs, etc., without the need of wood moulds or other internal supports of the concrete and with small surface tension in the fabric of the tubes while the tubes are under air pressure.

Figure 25:
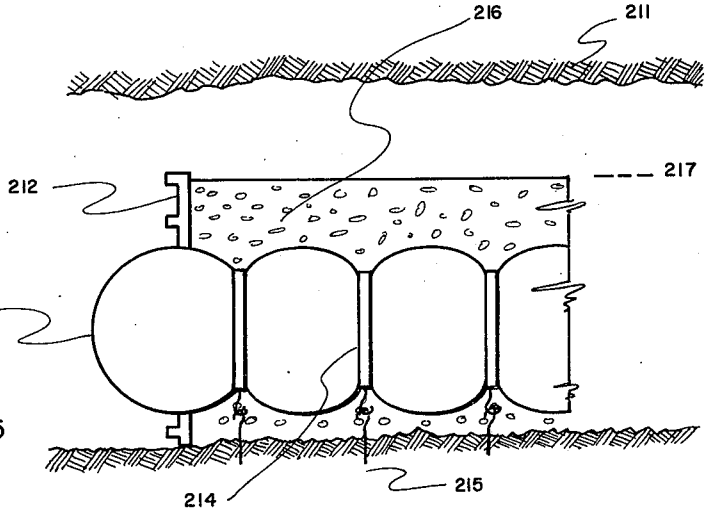
FIG. 25 shows a tubular air bag in which rings are placed to introduce double curvature into the bag to decrease surface tension simultaneously with a transmittal of buoyant forces to the ground floor.

FIG. 25 shows a special system to decrease surface tension of air bags as well as provide structurally efficient means to secure bags to the floor. It should be understood, to better comprehend the merits of FIG. 25, that the practical problems of large diameter air tubes are principally very large bag buoyant forces when fill is applied, and very large bag surface tension when air is applied.

A single solution to these two problems in which special cooperation is attained, is the use of external flexible rings which convert a single curvature air tube of radius $r$, into a tube with segments of double curvature between rings of radius $r$. Surface stress concentration at rings is taken by rings, which at the same time transmit to the floor, by means of floor bolts, the large buoyant surfaces generated by the fill against the bag.

FIG. 25 shows a stope at one end of which there is placed a temporary wood damn 212 through which one end an inflatable air tube 213 protrudes. Tube 213 is placed within flexible but relatively non-stretchable rings 214 secured to the floor of stope by means of floor bolts 215. Air is applied to bag and evidently double curvature forms between rings, by larger stretch of fabric against less stretch of ring, or by making fabric bag of slightly larger diameter than rings. The advantages of the double curvature are explained as follows.

Evidently, in a single curvature cylinder, the radius below its axially oriented rectilinear surface component is infinity, but in an orthogonal direction to that component, the radius is finite and equal to the cylinder's radius. The surface tension for a single curvature cylinder is proportional to its radius. In the double curvature segments in FIG. 25 however, between the rings, the radius in both direction is finite and small, and even though slightly larger than the radius of ring 124, the surface tension is smaller nevertheless in my double curvature segment in FIG. 25, than would be the case in a single curvature cylinder of a radius equal to that of the ring of the double curvature structure. Note that the stress concentration requires the use of a strong external ring, which can therefore also serve structurally as the very same element which collects buoyant forces from the tube for their transmittal by tension members to the ground.

In FIG. 25, once the tube is inflated, fill 216 with cement, or concrete, can be poured to level 217. From that level, once fill is solidified, there can be mined the next cut of the ascending cut and fill operation.

Once the air tube is withdrawn, a horizontal concrete floor can be applied within the arched floor to permit horizontal smooth motion of vehicles, the placement of rails, and similar facilities.

FIG. 26 shows the use of air tubes 225 resting against ore 222 to define a passageway along the long wall font of ore 222, even when fill 224 is poured by pipe 223 into space 221 adjacent to solidified fill 220. Accessway 229 remains free of fill by virtue of wood dams 226 used for drainage, but the opposite accessway 228 remains free of fill due to the containment provided by separate body 227. Body 227 is constructed of a solidified homogeneous continuous light-weight substance such as styrene, which supports the external pressures applied to it by the fill by virtue of internal pressures of the substance. Body 227 can be restrained in place against buoyant forces in any of the methods described earlier in the specifications.

Although the numbers in FIG. 227 give the impression that FIG. 26 shows an approximately horizontal work, this is not intended as a limit to the Figure, as it is applicable to undercut vertical type of mining. In this case, accessways 228 and 229 are raises between which there is ore 222 having an upwardly facing floor against air tube 225. Cemented fill 224 is poured on top of tube 225 up to the roof level of previously set cemented fill 220. For such an application, the air tube is secured to the floor as shown in FIG. 5, and the undercut proceeds as shown generally in FIG. 2, except that the air tube is pressed against the floor. The special advantage of undercutting system as described in connection to FIG. 26 is that the drill of the undercut can be made in a long floor cut, and the blasting of the undercut does not produce rock expansion against the cemented fill because there is the empty space above the ore floor defined by the removable air tubes.

In the specification, reference has been made to inflatable tubes and air bag containers having external body shapes of the kind desired to be formed upon withdrawal of the body from the solidified material. It has been indicated that such bodies can be filled with other fluids, including water, or may be formed by low cost solidifiable material or reusable or discardable solids, including styrene-like material.

Distinguishing features in the invention are, that internal pressures in the body are provided by a generally homogenous and substantially continuous substance, which internal pressure reacts against and supports the external pressures which are generated on the body by the fillback material on which the body is immersed, and that therefore the continuity of the pressure fields in the fillback material within the mining excavation is not interrputed prior to its setting, by the presence of spaces within the fillback material having pressures substantially different from those of the backfill, such as ambient pressures.

It is in the special sense described above that the term space-occupying means is used in the claims of the invention, which is evidently different in kind from, and does not apply to, the conventional timbered galleries and steel manways often used within backfill material, in which their ambient pressure introduces large discontinuities in the pressure field of the setting backfill, with the corresponding road concentrations which make it necessary to use heavy and costly conventional structures.

I claim:

1. A method for constructing a chamber within backfill material placed in a mining excavation comprising the steps of a. placing space-occupying means in said excavation, with said space-occupying means having the general shape of said chamber, b. maintaining the shape of said space-occupying means through the use of fluid pressure maintained therein, c. placing a mixture of solids and liquids into said mining excavation around said space-occupying means, with said mixture having a structurally setting ingredient, d. setting said mixture around said space-occupying means to thus form a chamber whose shape is defined by said space-occupying means.

2. Claim 1, wherein the step of pouring said mixture includes pouring components of tailings of a concentrator.

3. Claim 2, wherein the step of pouring said mixture includes pouring fine components of tailings of the concentrator into said chamber after said mixture has solidified around said space-occupying means.

4. Claim 2, further including the step of storing contaminants in said chamber after said mixture has solidified around said space-occupying means.

5. Claim 1, in which after said mixture is solidified, ore is extracted from a second excavation adjacent said solidified mixture.

6. Claim 5, in which said ore extracted from said second excavation is transported through said chamber.

7. Claim 1, in which after said mixture is solidified, a new excavation is made below said solidified mixture.

8. Claim 7, in which fill for said new excavation is transported through and applied from within said chamber above said new excavation.

9. A method to reduce the amount of backfill needed in backfilling an excavation and provide haulageway for mining comprising:

a. placing an inflatable container within an excavation to be backfilled, b. inflating said container to the approximate size of the haulageways which is to be defined within the backfill material, c. placing a fill material containing a mixture of liquids and solids and containing a substance to solidify said fill around said container, d. reducing pressure from said container and using the volume within the boundaries of the fill defined by the container as haulageways.

10. In an underground mining operation a method of providing light weight and low volume structural backfill for a mined area comprising:

a. placing an inflatable container within the mined area, b. inflating said container to an internal pressure greater than atmospheric, c. placing around said container and within said mined area a mixture of liquids and solids with a solidifying substance, d. setting said mixture around said container to define said structural backfill to thus reduce the quantity of backfill material needed to backfill the mined area.

11. A method for disposing fine and coarse tailings of a mine concentrator in an underground excavation comprising:

a. placing within said excavation an inflatable container, b. inflating said container to a pressure higher than atmospheric pressure, c. placing around said container a first mixture of liquids and coarse components of tailings of the concentrator together with a solidifying substance, d. draining and setting of said first mixture around said container to form a chamber within said first mixture, e. placing within said chamber a second mixture of liquids plus fine components of tailings of the concentrator.

12. For an underground mining operation, a method for constructing a chamber within backfill material placed in a mined area comprising:

a. placing space occupying means in said mined area, with said space occupying means having the general shape of said chamber, b. placing a solidifiable mixture of liquids and solids in said mined area around said space occupying means, c. setting said mixture to define the walls of said chamber around said space occupying means.

13. Claim 12 in which said space occupying means maintain their shape through the use of fluid pressure maintained therein.

14. Claim 12 in which a substantial portion of said space occupying means is air.

15. Claim 12 in which said space occupying means are inflatable containers.

16. Claim 15 in which said containers are elongated in shape and after the setting of said mixture, are withdrawn, thereby providing elongated chambers for transportation through the backfill material.

17. Claim 16, in which said elongated chamber is used for transporting air for ventilation.

18. For an underground mining operation, a method for reducing the amount of solidifiable material needed to backfill a mined area by providing regions within said solidifiable material from which said solidifiable material is excluded comprising:

a. placing space-occupying means in said mined area, b. placing a solidifiable mixture of liquids and solids in said mined area around said space occupying means, and c. setting said mixture whereby the amount of solidifiable material needed for backfill is less than if only solidifiable material were used.

19. Claim 18, in which said space-occupying means maintain their shape through the use of fluid pressure maintained therein.

20. In an underground mining operation, a method for providing a transportation chamber within solidifiable material backfilling a mined area comprising:

a. placing space-occupying means in said mined area with said space-occupying means having the general shape of said chamber, b. placing a mixture of solids and liquids into said mined area around said space-occupying means, said mixture having a structurally setting ingredient with said mixture generating a pressure against said space occupying means which is resisted by internal pressures within said space-occupying means, c. setting said mixture to thereby define a transportation chamber within said mixture, d. mining a second area adjacent said set mixture, and e. transporting ore from said second mined area through said transportation chamber.

21. Claim 20, in which said second mined area is above said mixture with said chamber being elongated in shape to serve as a principal extraction gallery for mining operations above the level of said transportation chamber.

22. In an underground mining operation the improvement comprising backfilling a mined out area such that the backfill has light weight and low volume comprising a. placing an inflatable container inside the mined area, b. inflating said container, c. placing around said container and within said mined area a mixture of liquids and solids with a solidifying substance, d. permitting the mixture to set whereby the amount and weight of backfill required to fill the mined out area is less than if only backfill had been used.

* * * * *